US010208410B2

(12) United States Patent
Gao et al.

(10) Patent No.: US 10,208,410 B2
(45) Date of Patent: Feb. 19, 2019

(54) BRAIDED TEXTILE SLEEVE WITH AXIALLY COLLAPSIBLE, ANTI-KINKING FEATURE AND METHOD OF CONSTRUCTION THEREOF

(71) Applicant: Federal-Mogul Powertrain, LLC, Southfield, MI (US)

(72) Inventors: Tianqi Gao, Exton, PA (US); Leigh Krauser, Coatesville, PA (US); Zhong Huai Zhang, Pottstown, PA (US); Michael Piotrowski, Plymouth Meeting, PA (US)

(73) Assignee: Federal-Mogul Powertrain LLC, Southfield, MI (US)

( * ) Notice: Subject to any disclaimer, the term of this patent is extended or adjusted under 35 U.S.C. 154(b) by 113 days.

(21) Appl. No.: 15/348,682

(22) Filed: Nov. 10, 2016

(65) Prior Publication Data

US 2017/0137978 A1 May 18, 2017

Related U.S. Application Data

(60) Provisional application No. 62/254,800, filed on Nov. 13, 2015.

(51) Int. Cl.
*D04C 1/06* (2006.01)
*D04C 1/02* (2006.01)

(52) U.S. Cl.
CPC ..... *D04C 1/06* (2013.01); *D04C 1/02* (2013.01); *D10B 2505/12* (2013.01)

(58) Field of Classification Search
CPC ... D04C 1/00; D04C 1/02; D04C 1/04; D04C 1/06; D04C 1/08; D04C 1/10; D04C 1/12
See application file for complete search history.

(56) References Cited

U.S. PATENT DOCUMENTS 304,045 A * 8/1884 Tolman ..... D04C 1/06 152/536
746,548 A * 12/1903 Mittendorff ..... D04C 1/06 87/11

(Continued)

FOREIGN PATENT DOCUMENTS

| | | |
|---|---|---|
| EP | 1775811 A1 | 4/2007 |
| EP | 2312192 A1 | 4/2011 |
| WO | WO 95/13495 | 5/1995 |

OTHER PUBLICATIONS

International Search Report, dated Feb. 23, 2017 (PCT/US2016/061526).

*Primary Examiner* — Shaun R Hurley
*Assistant Examiner* — Bao-Thieu L Nguyen
(74) *Attorney, Agent, or Firm* — Robert L Stearns; Dickinson Wright, PLLC

(57) ABSTRACT

A protective textile sleeve and method of construction thereof are provided. The sleeve has a tubular wall of braided yarns extending lengthwise along a central longitudinal axis between opposite ends. At least some of the braided yarns including heat-set yarns, and the wall has a plurality of annular first regions forming generally convex ridges and a plurality of annular second regions forming generally concave valleys. The first regions alternate with the second regions along the central longitudinal axis. The first regions include a plurality of twisted yarns forming a plurality of closed loops, wherein at least some of the braided yarns pass through at least some of the closed loops within the first regions to enhance the radial stiffness and resistance of the wall to kinking.

15 Claims, 6 Drawing Sheets

(56) References Cited

U.S. PATENT DOCUMENTS 1,887,643 A * 11/1932 Huber ..... D04C 1/00 450/156
2,022,350 A * 11/1935 Huber ..... D04C 1/02 66/172 E
2,836,181 A * 5/1958 Tapp ..... A61F 2/06 138/121
4,144,115 A * 3/1979 Sundberg ..... D04C 1/06 156/148
4,719,837 A * 1/1988 McConnell ..... B29C 70/24 156/148
4,741,087 A * 5/1988 Plummer, Jr. ..... B29C 61/0658 138/123
4,922,968 A * 5/1990 Bottger ..... B29C 70/222 139/384 R
5,197,370 A * 3/1993 Gladfelter ..... D04C 1/06 87/7
5,421,128 A * 6/1995 Sharpless ..... B64C 3/30 52/2.13
5,619,903 A * 4/1997 Rogers ..... D04C 1/06 87/5
5,697,969 A * 12/1997 Schmitt ..... A61F 2/06 600/36
5,700,533 A * 12/1997 You ..... D04C 1/06 428/36.3
5,843,542 A 12/1998 Brushafer et al.
5,899,134 A * 5/1999 Klein ..... D04C 1/02 87/13
5,939,216 A * 8/1999 Kameda ..... C04B 35/08 428/323
6,655,253 B2 * 12/2003 Uchida ..... D04C 1/06 87/6
6,711,920 B2 3/2004 Akers et al.
7,213,495 B2 * 5/2007 McCullagh ..... A61F 2/90 87/9
8,491,649 B2 * 7/2013 Mach ..... A61F 2/07 138/121
8,511,214 B2 8/2013 Gries
8,859,088 B2 * 10/2014 Broughton, Jr. ..... E04C 3/28 264/258
8,910,555 B2 * 12/2014 Janardhan ..... A61F 2/01 228/47.1
8,919,389 B2 12/2014 Gries
9,038,520 B2 * 5/2015 Kang ..... F16F 1/00 87/9
9,840,792 B2 * 12/2017 Broughton, Jr. ..... D02G 3/385
2003/0135265 A1 * 7/2003 Stinson ..... A61F 2/90 623/1.16
2009/0306762 A1 * 12/2009 McCullagh ..... A61F 2/90 623/1.13
2010/0023047 A1 * 1/2010 Simpson ..... A61F 2/958 606/192
2010/0030321 A1 * 2/2010 Mach ..... A61F 2/07 623/1.18
2011/0203446 A1 * 8/2011 Dow ..... D04C 1/06 87/11
2013/0112070 A1 * 5/2013 Mach ..... A61F 2/07 87/9
2013/0167710 A1 * 7/2013 Dow ..... D04C 1/06 87/9
2013/0204354 A1 * 8/2013 Adams ..... A61F 2/90 623/1.35
2014/0013931 A1 * 1/2014 Dow ..... D04C 3/00 87/11
2014/0220276 A1 * 8/2014 Gao ..... F16L 57/06 428/36.1
2014/0273699 A1 * 9/2014 Zhang ..... D04B 21/14 442/316
2014/0377488 A1 * 12/2014 Jamison ..... A43B 1/04 428/36.1
2015/0041016 A1 2/2015 Ragner
2015/0201707 A1 * 7/2015 Bruce ..... A43B 23/0235 36/47
2015/0217508 A1 * 8/2015 Rossi ..... B29D 99/0007 428/80
2016/0010248 A1 * 1/2016 Lariviere ..... D04C 1/06 87/7
2016/0122915 A1 * 5/2016 Fathallah ..... D04C 1/06 428/36.3
2016/0122916 A1 * 5/2016 Fathallah ..... D04C 1/06 87/9
2016/0289873 A1 * 10/2016 Head ..... D04C 3/24
2016/0305052 A1 * 10/2016 Broughton, Jr. ..... D04C 1/06
2016/0374841 A1 * 12/2016 Simpson ..... A61F 2/958 606/108
2017/0044697 A1 * 2/2017 Simpson ..... A61M 25/10
2017/0121868 A1 * 5/2017 Zhang ..... D03D 3/02
2017/0121871 A1 * 5/2017 Krauser ..... D04C 1/06
2017/0181761 A1 * 6/2017 Janardhan ..... A61B 17/221
2017/0204544 A1 * 7/2017 Cooke ..... D04C 1/02
2017/0226671 A1 * 8/2017 Zhang ..... D04C 1/06
2017/0304093 A1 * 10/2017 During ..... A61F 2/90
2018/0020762 A1 * 1/2018 Jamison ..... A43B 1/04
2018/0085136 A1 * 3/2018 Janardhan ..... A61B 17/12109

* cited by examiner

BRAIDED TEXTILE SLEEVE WITH AXIALLY COLLAPSIBLE, ANTI-KINKING FEATURE AND METHOD OF CONSTRUCTION THEREOF

CROSS-REFERENCE TO RELATED APPLICATION

This application claims the benefit of U.S. Provisional Application Ser. No. 62/254,800, filed Nov. 13, 2015, which is incorporated herein by reference in its entirety.

BACKGROUND OF THE INVENTION

1. Technical Field

This invention relates generally to textile sleeves, and more particularly to braided textile sleeves.

2. Related Art

It is known to protect elongate members in braided textile sleeves against a variety of environmental conditions and affects, or to just contain elongate members in textile sleeves for bundling and routing purposes. In the case of braided sleeves, the braided wall is commonly braided as a circumferentially continuous, seamless wall, sometimes referred to as a 'closed' wall. One known advantage of a closed, braided wall construction, in contrast to woven or knit wall constructions, is that the wall can be circumferentially expanded by pushing the opposite ends toward one another during installation to facilitate sliding the wall over an elongated member. However, a known problem with braided sleeves can arise during installation, particularly when trying to install the sleeve over relatively lengthy elongate members, such as wires and tubes, and/or about relatively sharp bends or corners. Commonly, when confronted with lengthy elongate members and sharp bends, the sleeves tend to flatten on themselves and kink, particularly within the region of a bend, thereby causing the material of the sleeve to bunch-up axially on itself, and thus, the sleeve ceases to continue along the length of the elongate member, thereby complicating the installation process.

SUMMARY OF THE INVENTION

In accordance with one aspect of the invention, a protective textile sleeve is provided. The sleeve has a tubular wall of braided yarns extending lengthwise along a central longitudinal axis between opposite ends. At least some of the braided yarns including heat-set yarns. The wall has a plurality of annular first regions forming generally convex ridges and a plurality of annular second regions forming generally concave valleys. The first regions alternate with the second regions along the central longitudinal axis. The first regions including a plurality of twisted yarns forming a plurality of closed loops, wherein at least some of the braided yarns pass through at least some of the closed loops within the first regions.

In accordance with another aspect of the invention, the first regions can be provided having a first stiffness and the second regions can be provided having a second stiffness, with the first stiffness being greater than the second stiffness. Accordingly, the relatively increased stiffness first regions resist the wall from being circumferentially compressed and flattened, while the relatively decreased stiffness second regions provide axial flexibility and axial compressibility to facilitate routing the sleeve about bends without kinking.

In accordance with another aspect of the invention, the first regions can include heat-set yarns.

In accordance with another aspect of the invention, the heat-set-yarns can be provided as monofilaments.

In accordance with another aspect of the invention, the second regions can include non-heat-settable yarns.

In accordance with another aspect of the invention, the non-heat-settable yarns can be provided as relatively soft multifilaments to enhance the coverage protection offered by the sleeve and to enhance axial compressibility and flexibility of the wall to resist kinking.

In accordance with another aspect of the invention, at least some of the heat-set yarns can be braided in bundles, with each of the bundles including a plurality of yarns twisted with one another and forming closed loops, with at least some of the closed loops of one bundle being interlinked with at least some closed loops of another bundle in the first regions.

In accordance with another aspect of the invention, the second regions can be formed to include non-heat-set yarns, with the non-heat-set yarns extending through closed loops of the bundles to enhance the structural integrity of the sleeve.

In accordance with another aspect of the invention, a plurality of the yarns can be braided to pass through each of the closed loops.

In accordance with another aspect of the invention, the first regions can include yarns braided in a first pattern and the second regions can include yarns braided in a second pattern, wherein the first pattern is different from the second pattern, such that the first pattern has an increased stiffness against axial and radial compression relative to the second pattern, which in turn can provide enhanced flexibility.

In accordance with another aspect of the invention, the wall can be formed entirely of heat-set monofilaments.

In accordance with another aspect of the invention, a method of constructing a tubular protective textile sleeve is provided. The method includes braiding a plurality of yarns with one another to form a tubular wall extending lengthwise along a central longitudinal axis between opposite ends, with at least some of the yarns being provided as heat-settable yarns. Further, compressing the opposite ends of the tubular wall axially toward one another to a compressed state. Next, heat-setting the heat-settable yarns while the wall is in the compressed state to form a plurality of annular first regions and a plurality of annular second regions alternating with one another along the central longitudinal axis, wherein the first regions form generally convex ridges and the second regions form generally concave valleys.

In accordance with another aspect of the invention, the method can include braiding the wall on a lace-braiding machine.

In accordance with another aspect of the invention, the method can include braiding the wall as a seamless, circumferentially continuous wall.

In accordance with another aspect of the invention, the method can include forming the second regions including non-heat-settable yarns.

In accordance with another aspect of the invention, the method can include providing the non-heat-settable yarns as multifilaments.

In accordance with another aspect of the invention, the method can include providing the heat-settable yarns as monofilaments.

In accordance with another aspect of the invention, the method can include braiding at least some of the heat-settable yarns in twisted bundles having loops, and further including interlinking at least some of the loops of one bundle with at least some of the loops of another bundle in the first regions.

In accordance with another aspect of the invention, the method can include extending non-heat-settable yarns through at least some of the loops of the bundles.

In accordance with another aspect of the invention, the method can include braiding yarns in the first regions in a first pattern and braiding the second yarns in the second regions in a second pattern, the first pattern having an increased axial and radial stiffness relative to the second pattern.

In accordance with another aspect of the invention, the method can include braiding the wall entirely of heat-settable yarns.

In accordance with another aspect of the invention, the method can include braiding the first regions having a first stiffness and braiding the second regions having a second stiffness, with the first stiffness being greater than the second stiffness, such that the first regions provide the sleeve with enhanced hoop strength and anti-kinking properties and the second regions provide the sleeve with enhance flexibility and coverage.

BRIEF DESCRIPTION OF THE DRAWINGS

These and other aspects, features and advantages of the present invention will become more readily appreciated when considered in connection with the following detailed description of presently preferred embodiments and best mode, appended claims and accompanying drawings, in which:

DETAILED DESCRIPTION OF PRESENTLY PREFERRED EMBODIMENTS

Figure 1:
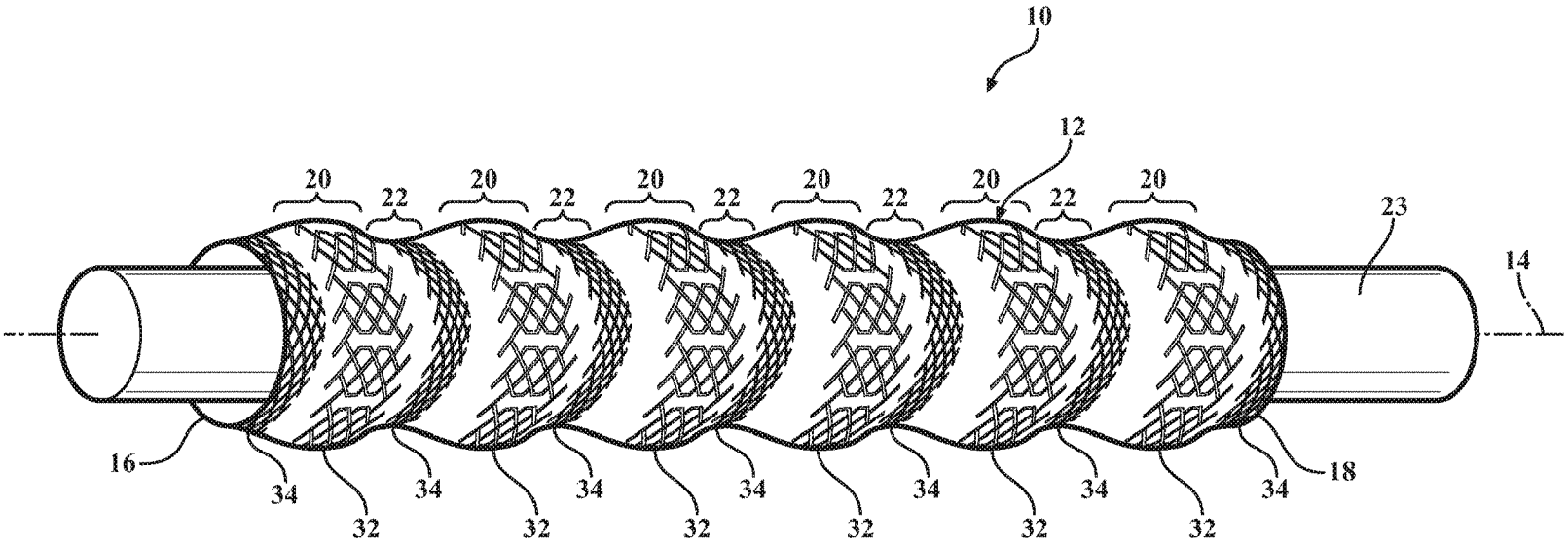
FIG. 1 is a schematic perspective view of a tubular braided sleeve constructed in accordance with one aspect of the invention shown disposed about an elongate member to be protected.

Referring in more detail to the drawings, FIG. 1 illustrates generally a braided protective textile sleeve, referred to hereafter as sleeve 10, constructed in accordance with one aspect of the invention. The sleeve 10 has a braided, circumferentially continuous, seamless tubular wall 12 extending lengthwise along a central longitudinal axis 14 between opposite open ends 16, 18. The wall 12 has a plurality of annular first regions 20 and a plurality of annular second regions 22 alternating with one another along the central longitudinal axis 14 to provide the wall 12 with axially collapsible features in the form of a corrugated or convoluted profile. The first regions 20 form generally bulbous, convex ridges having a first axial and radial stiffness and the second regions 22 form generally contracted, concave valleys having a second axial and radial stiffness, wherein the first stiffness is greater than the second stiffness. As a result of the differing region configurations and stiffness between the first and second regions 20, 22, the wall 12 is able to readily collapse and expand axially while retaining its structural integrity, including outer peripheral shape, during assembly and while in use, thereby making assembly of the sleeve 10 about an elongate member 23 to be received and protected therein easy, even over long elongate members 23 and about meandering paths and corners.

The wall 12 is preferably braided on a lace-braiding machine, though other braiding mechanisms are contemplated herein. In accordance with one aspect of the invention, the yarns forming or substantially forming the first regions 20 can be provided as heat-settable yarns 24 (substantially forming is meant to mean that a majority, such as greater than 75% content, by way of example and without limitation, of the yarn is heat-settable yarn 24) and the yarns forming or substantially forming the second regions 22 can be provided as non-heat-settable yarns 26 (substantially forming is meant to mean that a majority, such as greater than 75% content, by way of example and without limitation, of the yarn is non-heat-settable yarn 26). The heat-settable yarns 24 are preferably provided as monofilaments, while the non-heat-settable yarns are preferably provided as multifilaments, though it is contemplated herein the heat-settable multifilaments and non-heat-settable monofilaments could be used, depending on the application performance requirements. Regardless, the heat-settable yarns 24, particularly after being heat-set, as discussed below, are relatively stiff and rigid in comparison to the non-heat-settable yarns 26, while the non-heat-settable yarns 26 are relatively soft and flexible in comparison to the heat-settable yarns 24. Accordingly, the heat-settable yarns 24 can be provided as a heat-settable monofilament or a heat-settable multifilament, such as from, for example, nylon, polyphenylene sulfide (PPS), polyethyleneterephthalate (PET), or polypropylene (PP), having a diameter between about 0.1-0.40 mm, by way of example and without limitation, or being generally flat, having a thickness between about 0.15-0.25 mm and a width between about 1.0-3.5 mm, by way of example and without limitation. The non-heat-settable yarns 26 can be provided from any suitable non-heat-settable material, including, by way of example and without limitation, a mineral fiber, e.g. basalt, silica, or ceramic or fiberglass.

Figure 2A:
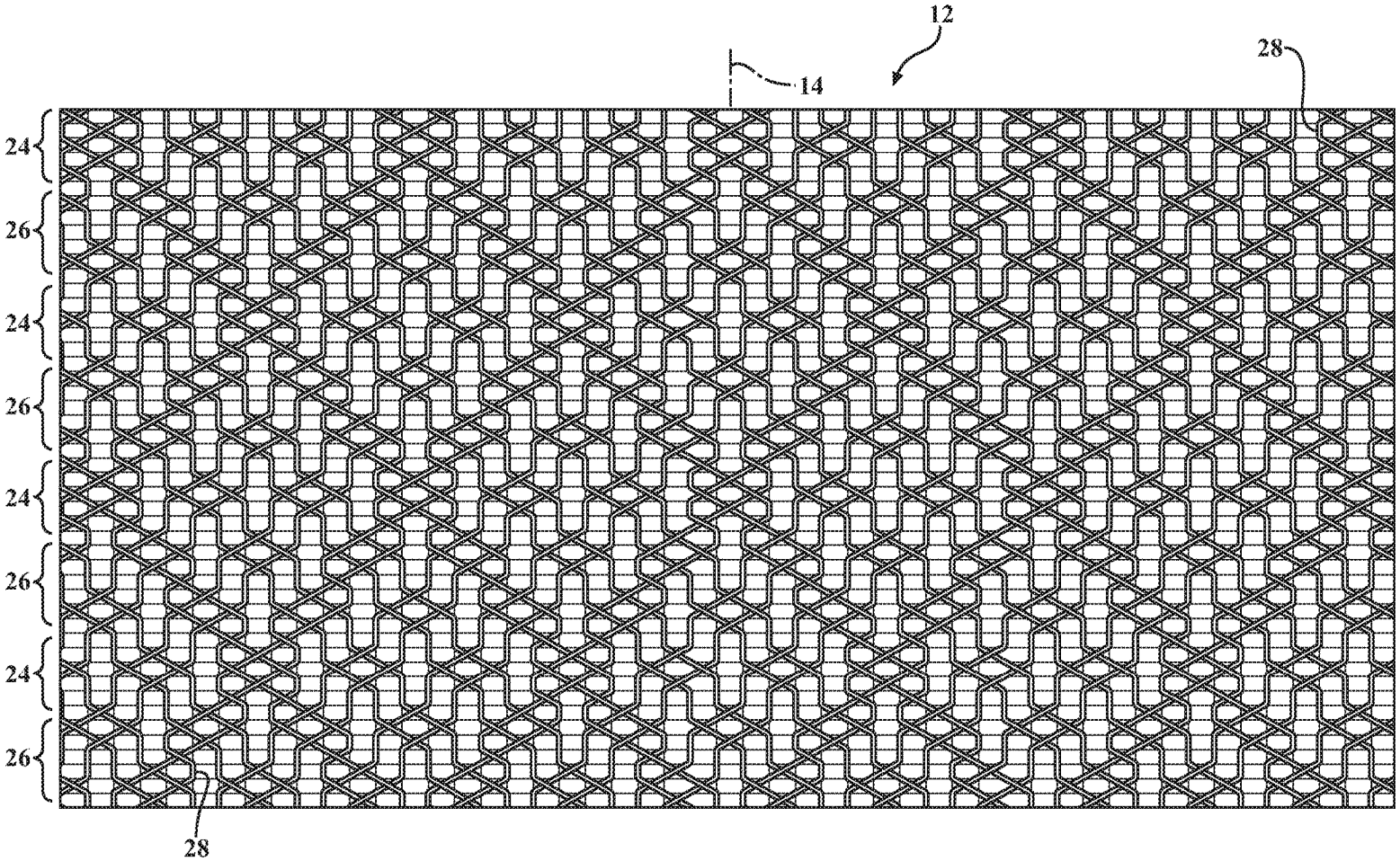
FIG. 2A is an enlarged fragmentary view showing the braid pattern of a wall of the sleeve of FIG. 1 in accordance with one aspect of the invention.
Figure 2B:
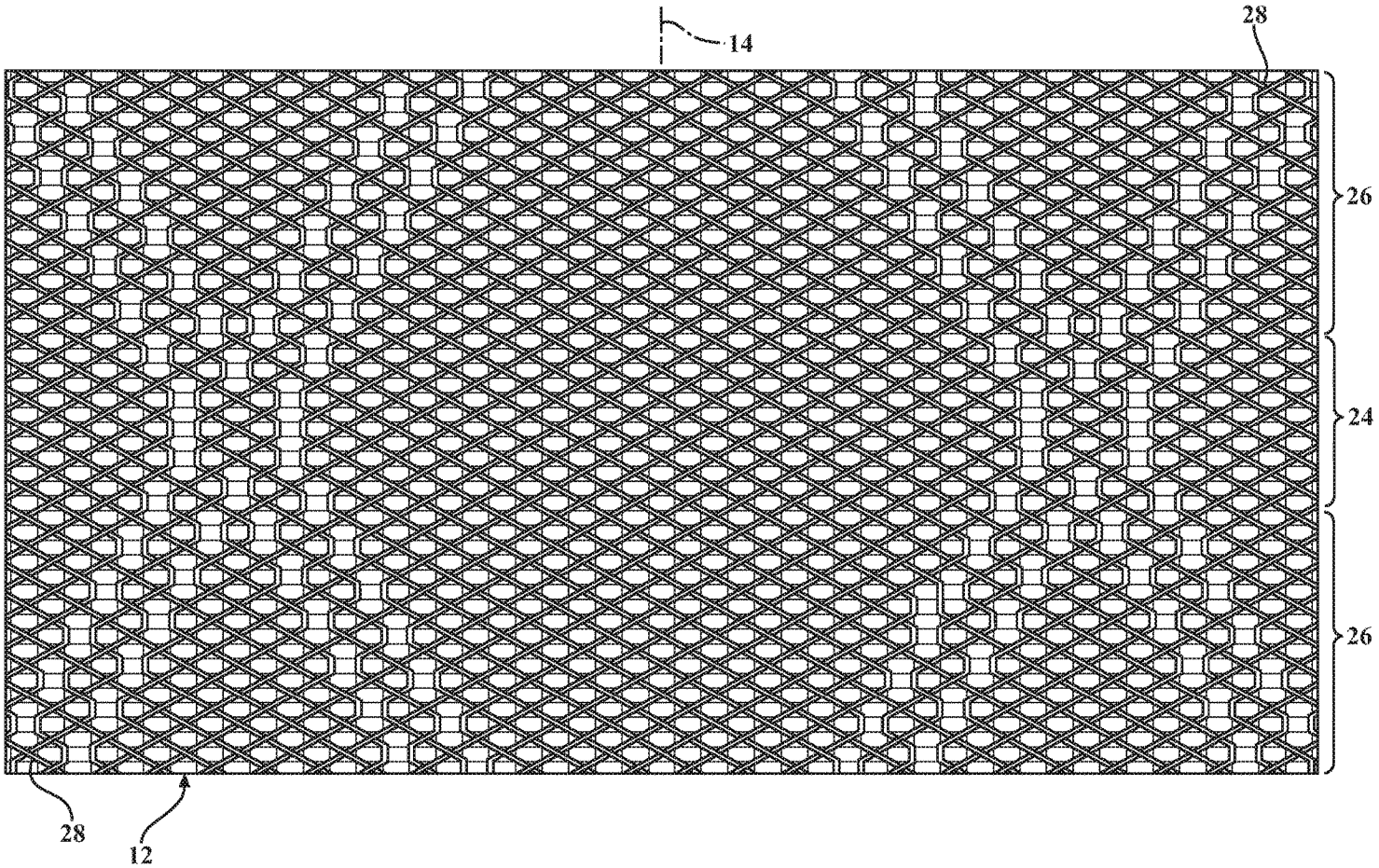
FIG. 2B is an enlarged fragmentary view showing the braid pattern of a wall of the sleeve of FIG. 1 in accordance with another aspect of the invention.

During the braiding process, the heat-settable yarns 24 are braided to form the substantial majority of, or the entirety of the first regions 20, while non-heat-settable yarns 26 are braided to form the substantial majority of, or the entirety of the second regions 22. Accordingly, the heat-settable yarns 24 are interlaced with one another to form or substantially form the first regions 20 and the non-heat-settable yarns 26 are interlaced with one another to form or substantially form the second regions 22. In FIGS. 2A and 2B, different braid patterns are shown in accordance with different aspects of the invention, while it should be recognized that other braid patterns providing relatively stiff first regions 20 and relatively soft, flexible second regions 22 are contemplated herein. The heat-settable yarns 24 in FIGS. 2A and 2B are shown as being braided as twisted bundles 28, wherein each bundle 28 includes a plurality of heat-settable yarns 24, shown as a pair of heat-settable yarns 24, by way of example and without limitation, twisted with one another to form closed loops 30. At least a portion or the entirety of the closed loops 30 within the first regions 20 are interlinked with one another such that the twisted bundles 28 are locked together. In FIG. 2A, within the second regions 26, the non-heat-settable yarns 26 are not only interlaced with one another in generally standard braided fashion, undulating over-and-under one another in alternating relation, by they also extend through closed loops 30 of the twisted bundles 28, while in FIG. 2B, the second regions 22 are formed entirely of the non-heat-settable yarns 26.

Figure 3A:
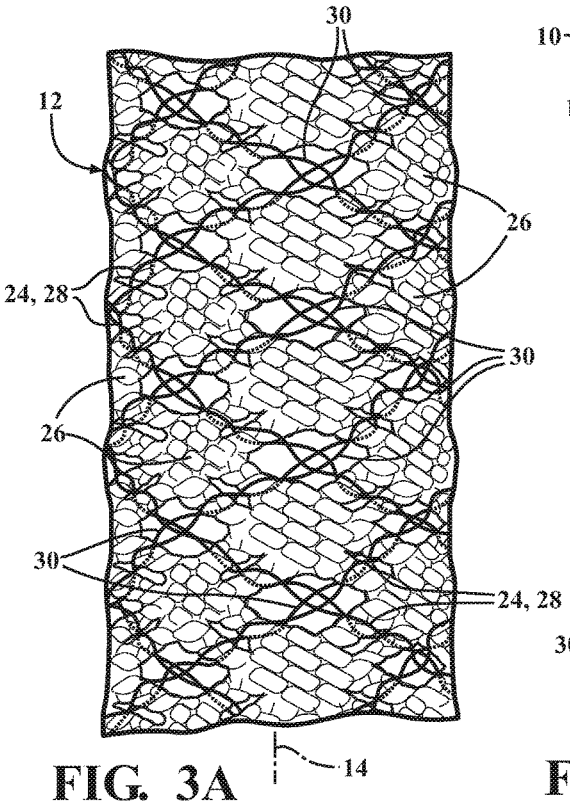
FIG. 3A is a fragmentary view of the sleeve of FIG. 1 constructed via the braid pattern of FIG. 2A shown in a braided, pre-compressed, pre-heat-set state.
Figure 3B:
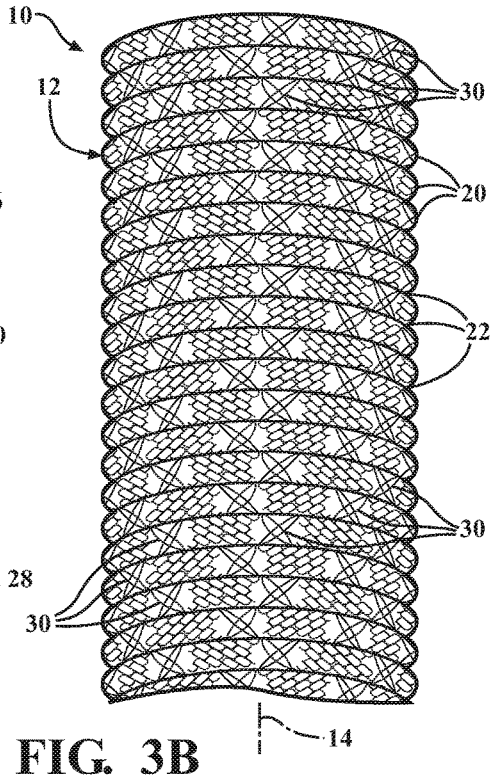
FIG. 3B is a view of the sleeve of FIG. 3B shown in an axially compressed, heat-set state.

Upon braiding the wall in accordance with the braid pattern of FIG. 2A, as shown in FIG. 3A, with the same process applying to that for the braid pattern of FIG. 2B, the opposite ends 16, 18 of the wall 12 are axially compressed toward one another, wherein during the compressing process, the first regions 20, being relatively stiff, form radially outwardly extending, bulbous convex ridges 32, while the second regions 22, being relatively soft and flexible, collapse radially to form radially inwardly extending, contracted concave valleys 34. While in the compressed state, the wall 12 is heat-set via application of a suitable degree of heat to cause the heat-settable yarns 24 to take on a heat-set configuration. Upon being heat-set, the wall 12 retains a corrugated or convoluted configuration while in a relaxed, unbiased state, as shown in FIG. 3B. It should be recognized the wall 12 can be axially compressed to the desired reduced length, whether fully compressed or partially compressed, and further, the wall 12 can be compressed in sections and heat set prior to cutting the sleeve to its finished length, or the wall 12 can be cut to length, then compressed to the desired length, and then heat-set. While compressing the wall 12, it is contemplated that the wall 12 can be disposed about a central mandrel to facilitate uniform compression of the wall 12 without buckling. Further, the mandrel could be heated to facilitate heat-setting the wall 12 while in its fully or partially compressed state.

Figure 3C:
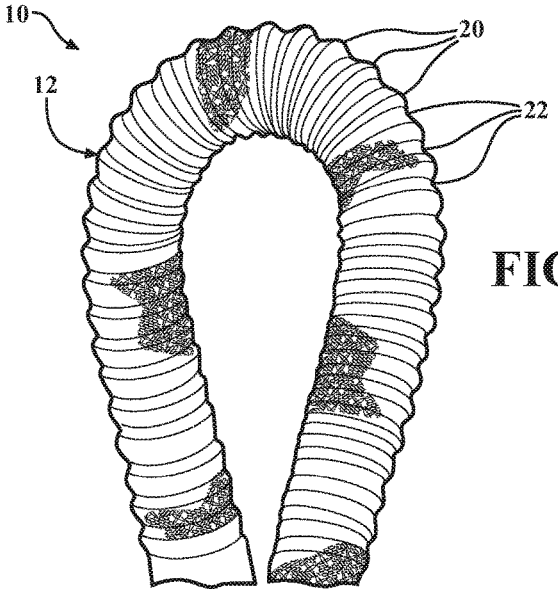
FIG. 3C is a view of the sleeve of FIG. 3B shown being routed about a sharp bend without kinking.

Upon being heat-set, the wall 12 retains the radially outwardly extending, relatively stiff first regions 20 and the radially inwardly extending, relatively soft and flexible second regions 22, and as a result, the sleeve 10 is readily able to be installed over relatively long, meandering elongate members 23, including around bends and corners, as shown in FIG. 3, without kinking or losing its "as constructed" outer peripheral shape, whether circular or non-circular, as viewed in lateral cross-section.

Figure 2C:
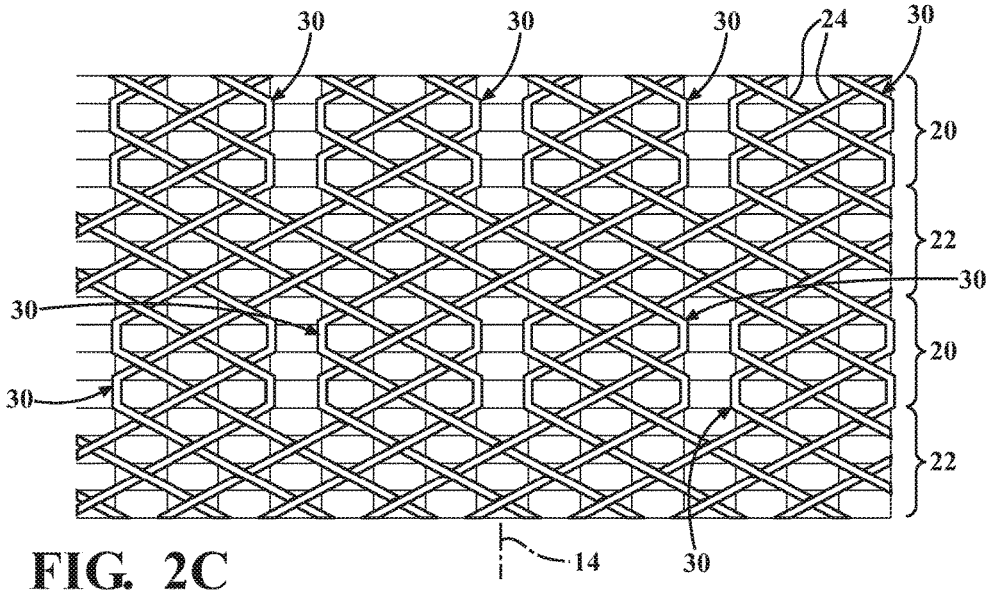
FIG. 2C is an enlarged fragmentary view showing the braid pattern of a wall of the sleeve of FIG. 1 in accordance with another aspect of the invention.
Figure 2D:
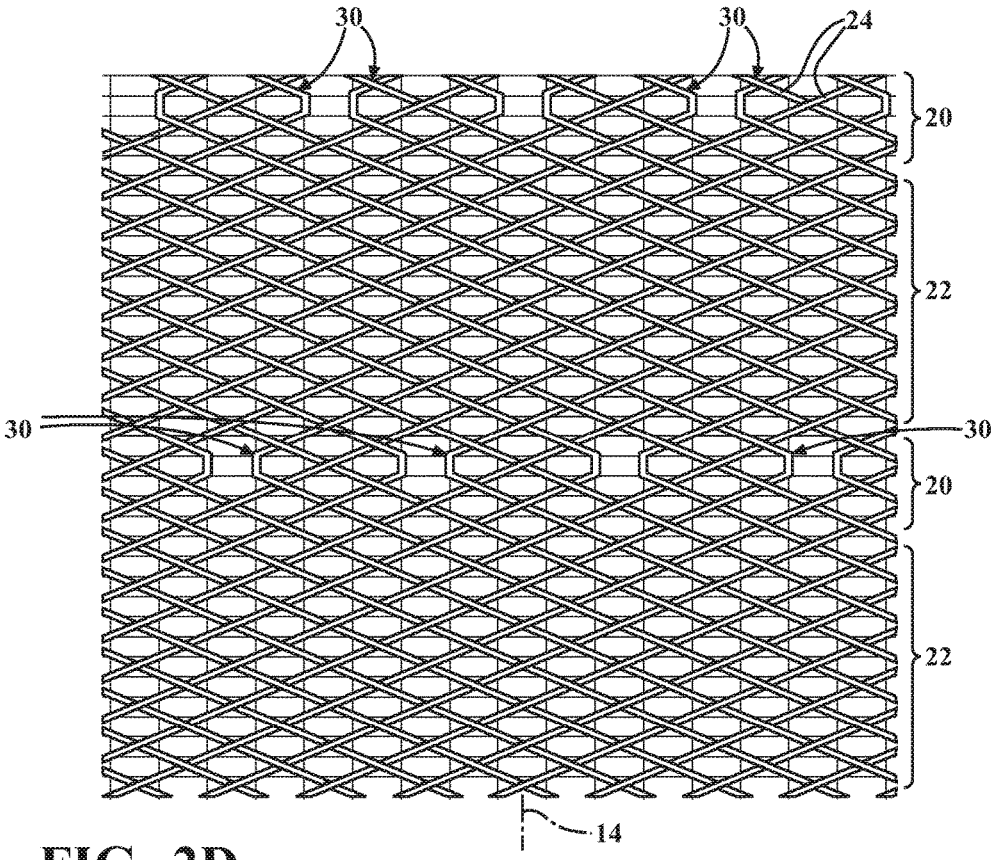
FIG. 2D is an enlarged fragmentary view showing the braid pattern of a wall of the sleeve of FIG. 1 in accordance with another aspect of the invention.

In FIGS. 2C and 2D, different braid patterns of the wall 12 in accordance with further embodiments of the sleeve 10 of FIG. 1 are shown, wherein the same reference numerals as above are used to indicate like features, while it should be recognized that other braid patterns providing relatively stiff first regions 20 and relatively soft, flexible second regions 22 are contemplated herein. The braid patterns shown in FIGS. 2C and 2D include solely heat-settable yarns 24, wherein the heat-settable yarns 24 are interlaced with themselves in a first standard braid pattern, undulating over-and-under one another in opposite helical S and Z directions throughout the second regions 22, while the heat-settable yarns 24 are interlaced with each other in a second braid pattern in the first regions 20, with the second braid pattern being formed by pairs 36 of the heat-settable yarns 24 looping about intermediate heat-settable yarns 24 and each other to change helical directions relative to one another. Accordingly, one of the yarns 24 in the pair of yarns 36 changes from an S or Z helical direction to the opposite S or Z direction with the first region 20, while the other of the yarns 24 in the pair of yarns 36 changes from an S or Z helical direction to the opposite S or Z direction with the first region 20, thereby forming closed loops 30. Extending through the closed loops 30 is a plurality, shown as a pair of heat-settable yarns 24, by way of example and without limitation, extending opposite helical directions to one another. The main difference between the braid patterns of FIGS. 2C and 2D is with regard to the axial length of the second, relatively flexible regions 22, wherein the second regions 22 of FIG. 2C are shown as being the same or substantially the same axial length as the relatively stiff first regions 20, and in contrast, the second regions 22 of FIG. 2D are shown as having an increased axial length relative to the relatively stiff first regions 20, shown as being about twice as long, by way of example and without limitation. It should be recognized that the first and second regions 20, 22 can be braided having any suitable axially extending length, wherein the first and second regions can all be about the same length, or they can vary in length individually or relative to one another over the length of the sleeve 10, as desired for the intended application.

Figure 4A:
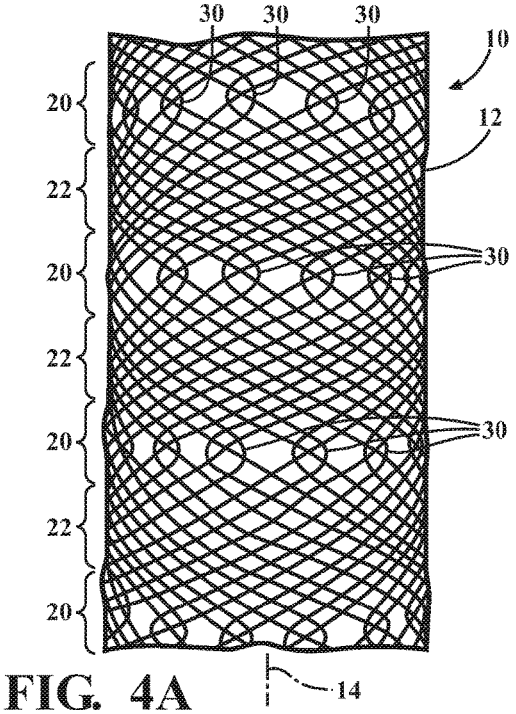
FIG. 4A is a fragmentary view of the sleeve of FIG. 1 constructed via the braid pattern of FIG. 2D shown in a braided, pre-compressed, pre-heat-set state.
Figure 4B:
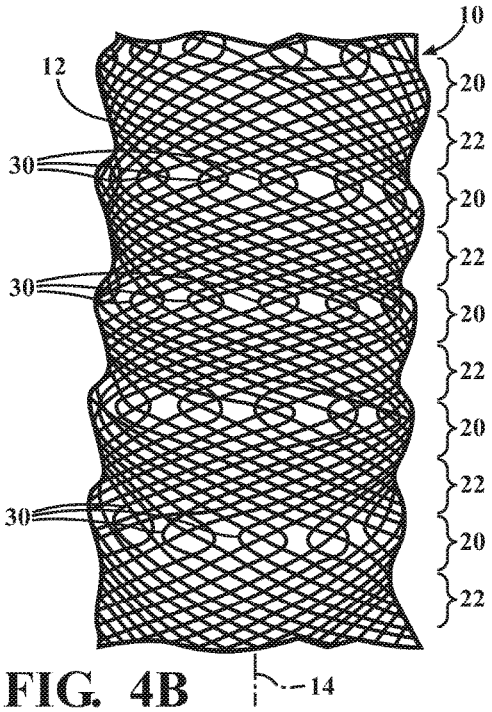
FIG. 4B is a fragmentary view of the sleeve of FIG. 4A shown in an axially compressed state.
Figure 4C:
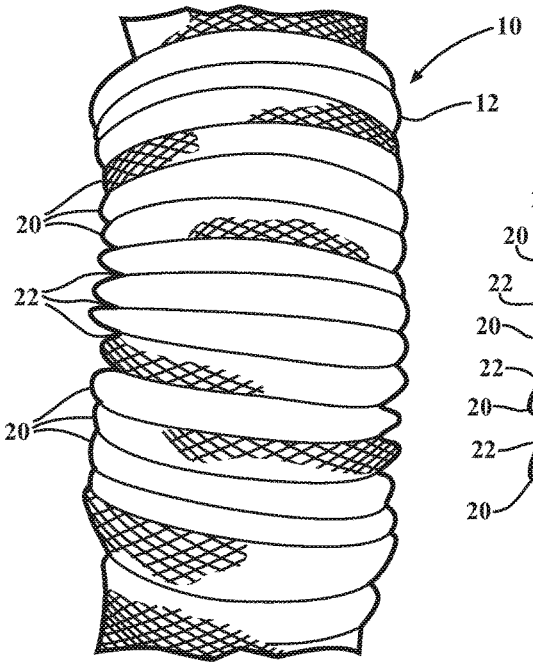
FIG. 4C is a fragmentary view of the sleeve of FIG. 4B shown in an axially compressed, heat-set state.

Upon braiding the wall in accordance with the braid patterns of FIGS. 2C and 2D, as shown in FIG. 4A for the braid pattern of FIG. 2D, though the same process applies to the braid pattern of FIG. 2C, the opposite ends 16, 18 of the wall 12 are axially compressed toward one another, wherein during the compressing process, the first regions 20, being relatively stiff, form radially outwardly extending, convex ridges 32, while the second regions 22, being relatively flexible, form radially inwardly extending, concave valleys 34, with the wall 12 taking a generally bellowed or convolute shape, as shown in FIG. 4B. While in the compressed state, the wall 12 is heat-set via application of a suitable degree of heat to cause the heat-settable yarns 24 to take on a heat-set configuration. Upon being heat-set, the wall 12 retains a corrugated or convoluted configuration while in a relaxed, unbiased state, as shown in FIG. 4C. It should be recognized the wall 12 can be axially compressed to the desired reduced length, whether fully compressed or partially compressed, and further, the wall 12 can be compressed in sections and heat set prior to cutting the sleeve to its finished length, or the wall 12 can be cut to length, then compressed to the desired length, and then heat-set. While compressing the wall 12, it is contemplated that the wall 12 can be disposed about a central mandrel to facilitate uniform compression of the wall 12 without buckling. Further, the mandrel could be heated to facilitate heat-setting the wall 12 while in its fully or partially compressed state.

Figure 4D:
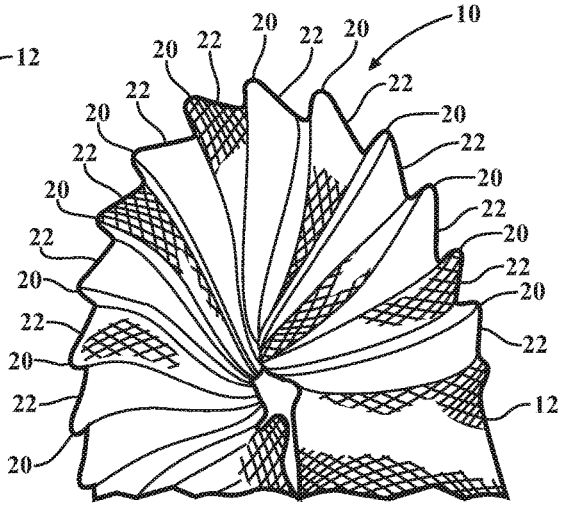
FIG. 4D is a fragmentary view of the sleeve of FIG. 4C shown being routed about a sharp bend without kinking.

Upon being heat-set, the wall 12 retains the radially outwardly extending, relatively stiff first regions 20 and the radially inwardly extending, relatively soft and flexible second regions 22. As a result, the sleeve 10 is readily able to be installed over relatively long, meandering elongate members 23, including around bends and corners, as shown in FIG. 4D, without kinking or losing its "as constructed" outer peripheral shape, such as round, by way of example and without limitation. As the sleeve 10 is being routed around bends, the flexible, softer second regions 22 are able to collapse axially, while the first regions 20 maintain the peripheral profile of the wall 12, whether circular or non-circular, as viewed in lateral cross-section, thereby maintaining or substantially maintaining the "as constructed" outer peripheral shape of the wall 12. Accordingly, assembly of the sleeve 10 over the length of generally long, meandering elongate members 23 is greatly simplified.

Many modifications and variations of the present invention are possible in light of the above teachings. It is, therefore, to be understood that the invention may be practiced otherwise than as specifically described, and that the scope of the invention is defined by any ultimately allowed claims.

What is claimed is:

1. A protective textile sleeve, comprising:

a tubular wall of braided yarns extending lengthwise along a central longitudinal axis between opposite ends, at least some of said braided yarns including heat-set yarns; and said wall having a plurality of annular first regions forming generally convex ridges and a plurality of annular second regions forming generally concave valleys, said first regions alternating with said second regions along said central longitudinal axis to provide the wall with axially collapsible features, said first regions including a plurality of twisted yarns forming a plurality of closed loops, wherein at least some of said braided yarns pass through at least some of said closed loops within said first regions.

2. The protective sleeve of claim 1 wherein said second regions are free of said closed loops.

3. The protective sleeve of claim 2 wherein the entirety of said braided yarns include heat-set yarns.

4. The protective sleeve of claim 2 wherein a plurality of said braided yarns pass through each of said closed loops.

5. The protective sleeve of claim 1 wherein said first regions have a first stiffness and said second regions have a second stiffness, said first stiffness being greater than said second stiffness.

6. The protective sleeve of claim 5 wherein said first regions include said heat-set yarns.

7. The protective sleeve of claim 6 wherein said heat-set-yarns are monofilaments.

8. The protective sleeve of claim 5 wherein said second regions include non-heat-settable yarns.

9. The protective sleeve of claim 8 wherein said non-heat-settable yarns are multifilaments.

10. The protective sleeve of claim 9 wherein at least some of said multifilaments pass through at least some of said closed loops.

11. The protective sleeve of claim 1 wherein at least some of said heat-set yarns are braided in bundles, each of said bundles including a plurality of said closed loops, at least some of said closed loops of one bundle being interlinked with at least some of said closed loops of another bundle in said first regions.

12. The protective sleeve of claim 11 wherein said second regions include non-heat-settable yarns, said non-heat-settable yarns extending through said closed loops.

13. The protective sleeve of claim 11 wherein said second regions are free of said closed loops.

14. The protective sleeve of claim 1 wherein said first regions include yarns braided in a first pattern and said second regions include yarns braided in a second pattern, said first pattern being different from said second pattern.

15. The protective sleeve of claim 1 wherein said wall is formed entirely of heat-set monofilaments.

* * * * *